US007552692B2

(12) United States Patent
Campbell et al.

(10) Patent No.: US 7,552,692 B2
(45) Date of Patent: Jun. 30, 2009

(54) SPREADER TIP WITH DISCONTINUOUS EXTERNAL MOUNTING

(75) Inventors: Richard V. Campbell, Tallahassee, FL (US); David Hilbig, Cairo, GA (US); David Sediles, Tallahassee, FL (US)

(73) Assignee: Bright Technologies, LLC, Havana, FL (US)

( * ) Notice: Subject to any disclaimer, the term of this patent is extended or adjusted under 35 U.S.C. 154(b) by 0 days.

(21) Appl. No.: 11/580,549

(22) Filed: Oct. 13, 2006

(65) Prior Publication Data

US 2007/0216178 A1 Sep. 20, 2007

Related U.S. Application Data

(60) Provisional application No. 60/783,109, filed on Mar. 15, 2006.

(51) Int. Cl.
*B63H 9/04* (2006.01)

(52) U.S. Cl. ..... 114/111

(58) Field of Classification Search ..... 114/111; 440/111

See application file for complete search history.

(56) References Cited

U.S. PATENT DOCUMENTS 4,313,391 A * 2/1982 Hall ..... 114/90
5,458,076 A * 10/1995 Loutrel et al. ..... 114/111
5,988,089 A * 11/1999 Benoit ..... 114/102.1

* cited by examiner

*Primary Examiner*—Stephen Avila
(74) *Attorney, Agent, or Firm*—J. Wiley Horton

(57) ABSTRACT

A spreader tip which can be applied to a variety of different spreader bars having different shapes and sizes. The spreader tip features at least one mounting arm which is positioned to bear against a portion of the spreader bar's exterior. The engagement between the at least one mounting arm and the exterior of the spreader bar is discontinuous, in that it engages less than the entire circumference of the spreader bar's exterior.

12 Claims, 21 Drawing Sheets

SPREADER TIP WITH DISCONTINUOUS EXTERNAL MOUNTING

CROSS-REFERENCES TO RELATED APPLICATIONS

This is a non-provisional patent application claiming the benefit, under 37 CFR §1.53, of an earlier-filed provisional application. The earlier-filed application is as follows:

| Ser. No. | Named Inventor(s) | Filing Date |
|---|---|---|
| 60/783,109 | Richard v. Campbell, David Hilbig, David Sediles | Mar. 15, 2006 |

STATEMENT REGARDING FEDERALLY SPONSORED RESEARCH OR DEVELOPMENT

Not Applicable.

MICROFICHE APPENDIX

Not Applicable

BACKGROUND OF THE INVENTION

1. Field of the Invention

This invention relates to the field of sailboat rigging hardware. More specifically, the invention comprises a spreader tip which can be adapted to fit a variety of spreader bars.

2. Description of the Related Art

Sailboats typically use ropes or cables to stabilize the mast. FIG. 1 shows a simplified elevation view of a hull 24 with attached mast 10. The mast is anchored to the hull at its base. Stabilizing lines also run fore and aft ("fore stay" and "back stay"). Lateral stays are typically included as well. These are often spread away from the mast in order to provide additional rigidity. Two or more spreader bars 12 spread the cables 22 outward (at least one spreader bar on each side). The cable is secured to the outer extreme of the spreader bar, typically by passing the cable through some type of notch.

The cables used for all the stays are part of a system known as the "standing rigging." This name refers to the fact that it is erected and typically left in place (unless the mast is to be lowered). FIG. 2 shows a spreader bar 12 in more detail. It is joined to mast 10, often by a pinned sleeve or a weld seam. The spreader bar terminates in end 14. Metal spreader bars are typically hollow—as shown in the view. However, the end may sometimes be a solid surface. This is true for carbon fiber spreader bars or wooden spreader bars as well.

Spreader bars come in many different shapes. FIG. 3 shows three typical shapes—round, oval, and airfoil. An additional piece of hardware is typically attached to the spreader bar's end in order to provide the interface with the standing rigging. The additional piece of hardware must therefore be adapted to fit a particular spreader bar.

FIG. 4 shows a prior art spreader tip which is configured to mate with a particular size of oval spreader bar, where end 14 is hollow. The tip features a conformed plug 16 which fits snugly into the hollow portion of end 14 (It may even include a slight taper). The inward-facing side of rigging interface 18 bears against lateral facing surface 74. Rigging interface 18 also includes at least one cable receiver 20. When the conformed plug is pressed into the end and the cable is placed withing the cable receiver, those skilled in the art will know that tension on the cable will tend to force the conformed plug into the end of the spreader bar and thereby retain the spreader tip in position.

Tension is typically placed on cable 22 by tightening a turnbuckle. This action will create cable tension from the deck all the way up to the tip of the mast. The tension also tends to force the rigging interface against lateral facing surface 74.

Returning to FIG. 3, the reader will recall that spreader bars come in many different shapes. Many sizes are also encountered. Unfortunately, there is very little standardization. Thus, a dedicated spreader tip must be created for each size and shape of spreader bar. A spreader tip which could operate with a variety of different spreader bars would be advantageous.

Such a spreader tip would typically lie close against lateral facing surface 74. However, the reader should be aware that some prior art spreader tips are not removable. They may be welded in place or actually forms as part of the end of the spreader bar. In such an instance, the lateral facing surface against which the new spreader tip will rest may actually be the prior art spreader tip.

BRIEF SUMMARY OF THE PRESENT INVENTION

The present invention comprises a universal spreader tip which can be applied to a variety of different spreader bars having different shapes and sizes. The spreader tip features at least one mounting arm which is positioned to bear against a portion of the spreader bar's exterior. The engagement between the at least one mounting arm and the exterior of the spreader bar is discontinuous, in that it engages less than the entire circumference of the spreader bar's exterior.

Embodiments including one, two, three, and four mounting arms are illustrated. The mounting arms may be formed integrally with the rigging interface, or these two components may be made separately and joined together. The mounting arms are attached to the spreader bar by any suitable means, including bolting, riveting, banding, and welding.

REFERENCE NUMERALS IN THE DRAWINGS

| | | | |
|---|---|---|---|
| 10 | mast | 12 | spreader bar |
| 14 | end | 16 | conformed plug |
| 18 | rigging interface | 20 | cable receiver |
| 22 | cable | 24 | hull |
| 26 | universal spreader tip | 28 | rigging interface |
| 30 | cable receiver | 32 | mounting arm |
| 33 | threaded hole | 34 | through hole |
| 35 | arched mounting arm | 36 | mounting hole |
| 38 | bolt | 40 | bolt |
| 42 | drilled hole | 44 | washer |
| 46 | nut | 48 | contact point |
| 50 | screw clamp | 52 | inner surface |
| 54 | threaded hole | 56 | adjustable mounting arm |
| 58 | mounting plate | 60 | vertical slot |
| 62 | bolt | 64 | wide mounting arm |
| 66 | U-bolt | 68 | lateral slot |
| 70 | lateral mounting arm | 72 | circumference |
| 74 | lateral facing surface | 78 | lower mounting arm |
| 80 | spacer | 82 | upper mounting arm |
| 84 | mounting arm | 86 | weld |

DETAILED DESCRIPTION OF THE INVENTION

Figure 1:
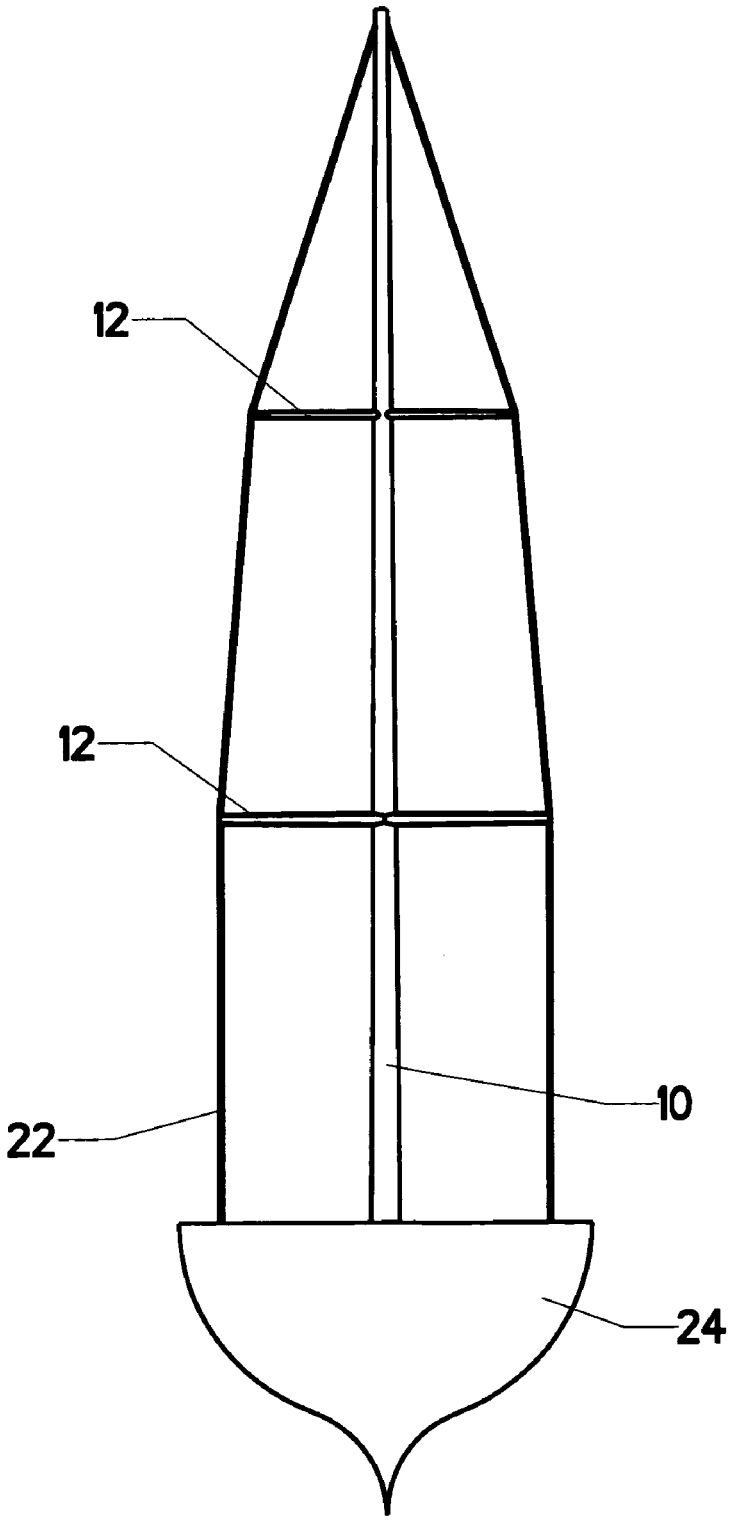
FIG. 1 (PRIOR ART)
FIG. 1 is an elevation view, showing prior art lateral stays on a sailboat.
Figure 2:
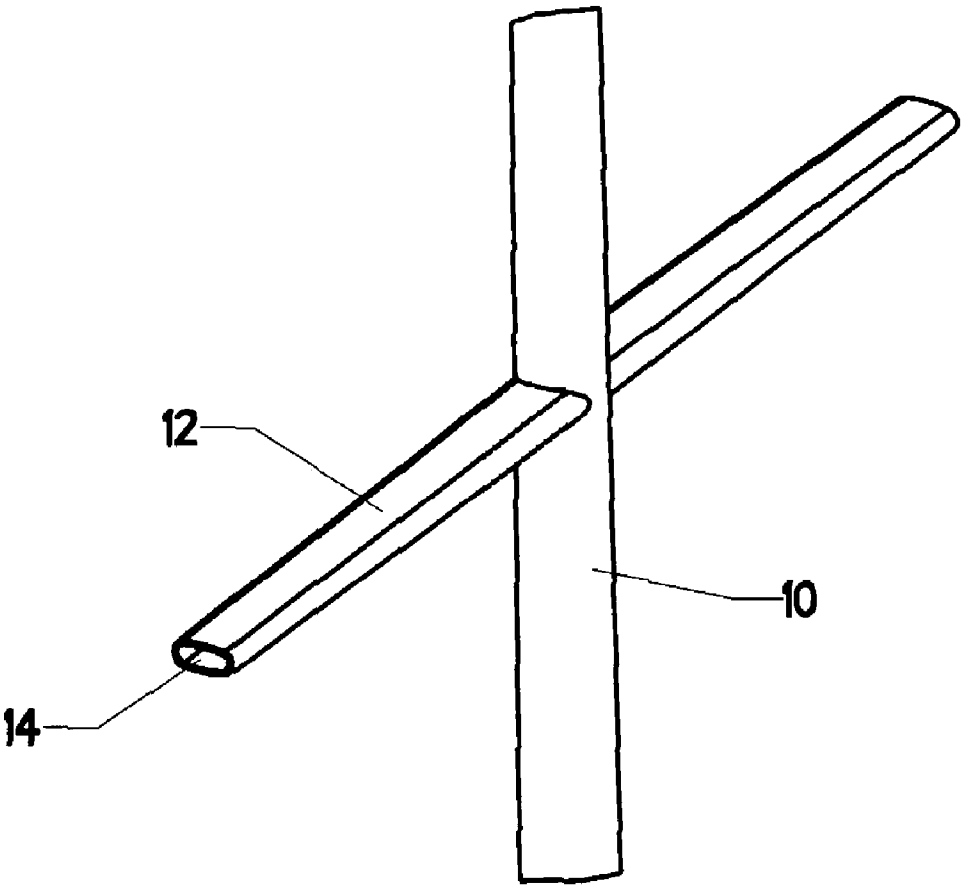
FIG. 2 (PRIOR ART)
FIG. 2 is a perspective view, showing a spreader bar in more detail.
Figure 3:
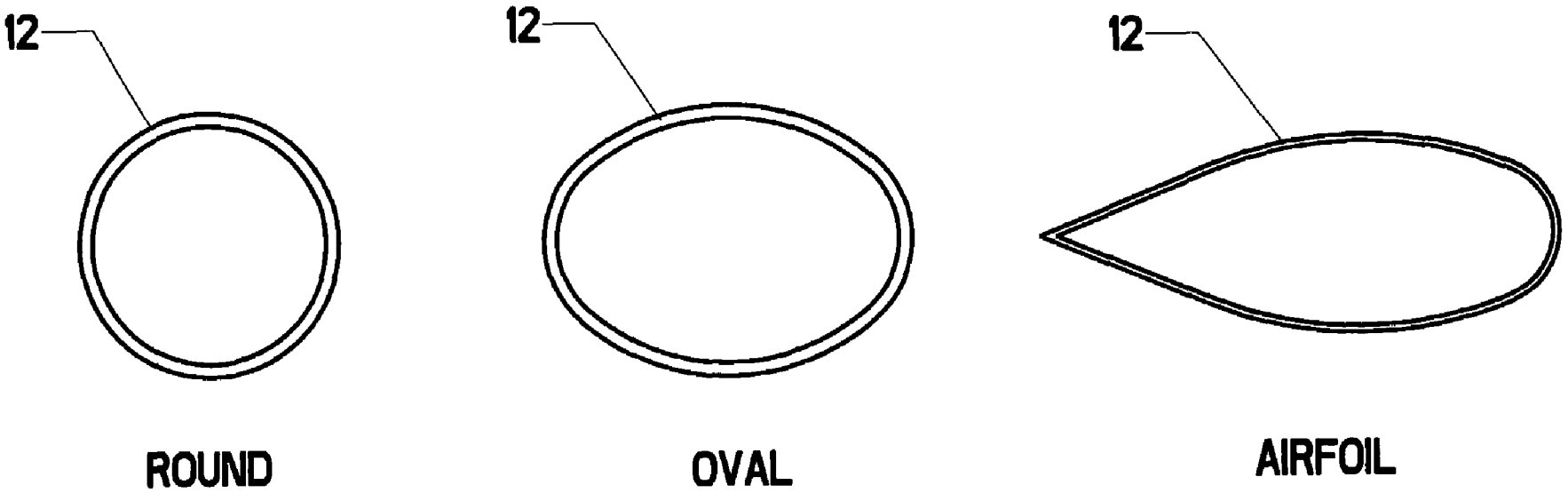
FIG. 3 (PRIOR ART)
FIG. 3 is a sectional view, showing different shapes used in prior art spreader bars.
Figure 4:
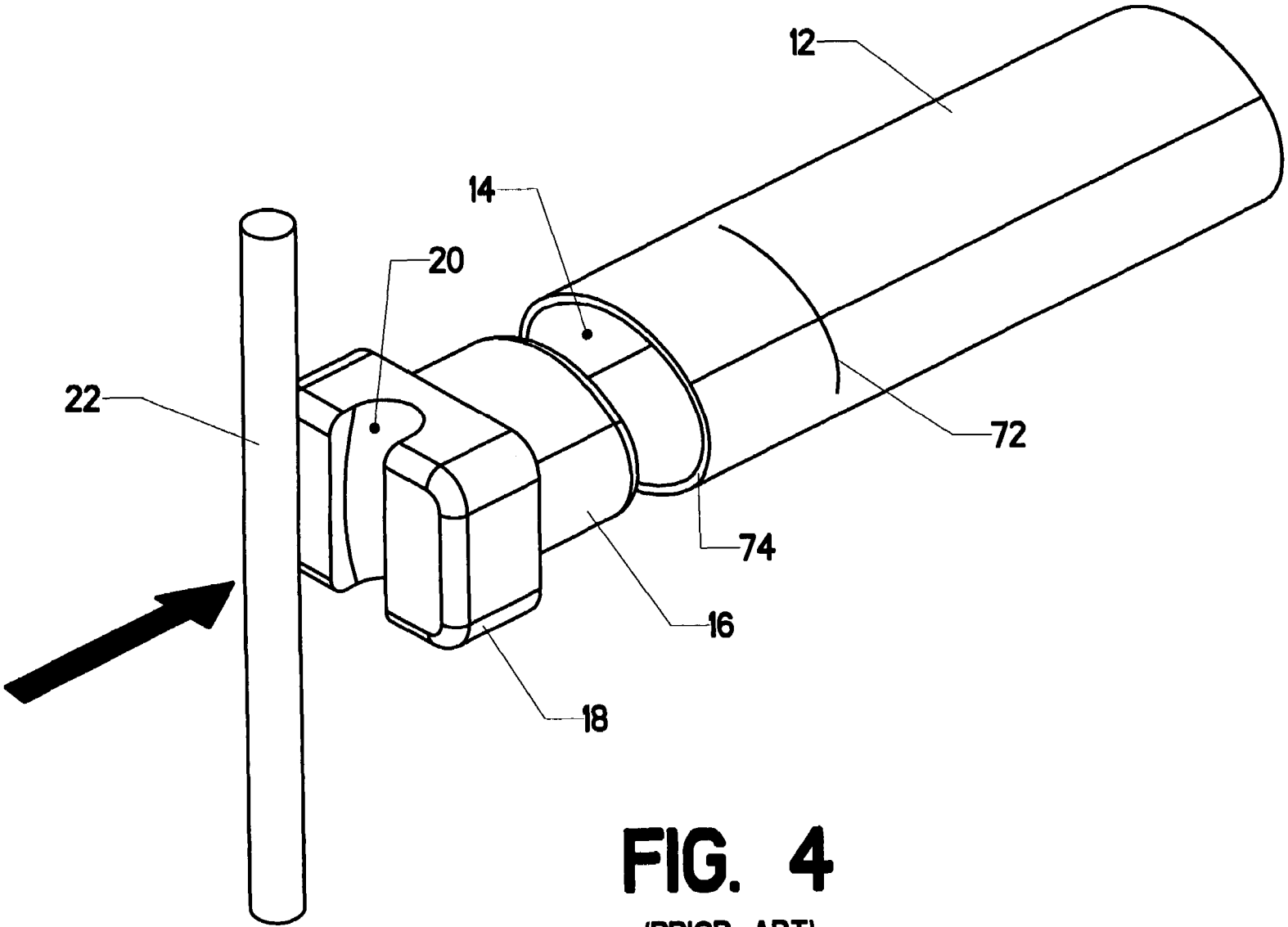
FIG. 4 (PRIOR ART)
FIG. 4 is a perspective view, showing a prior art spreader tip.
Figure 5:
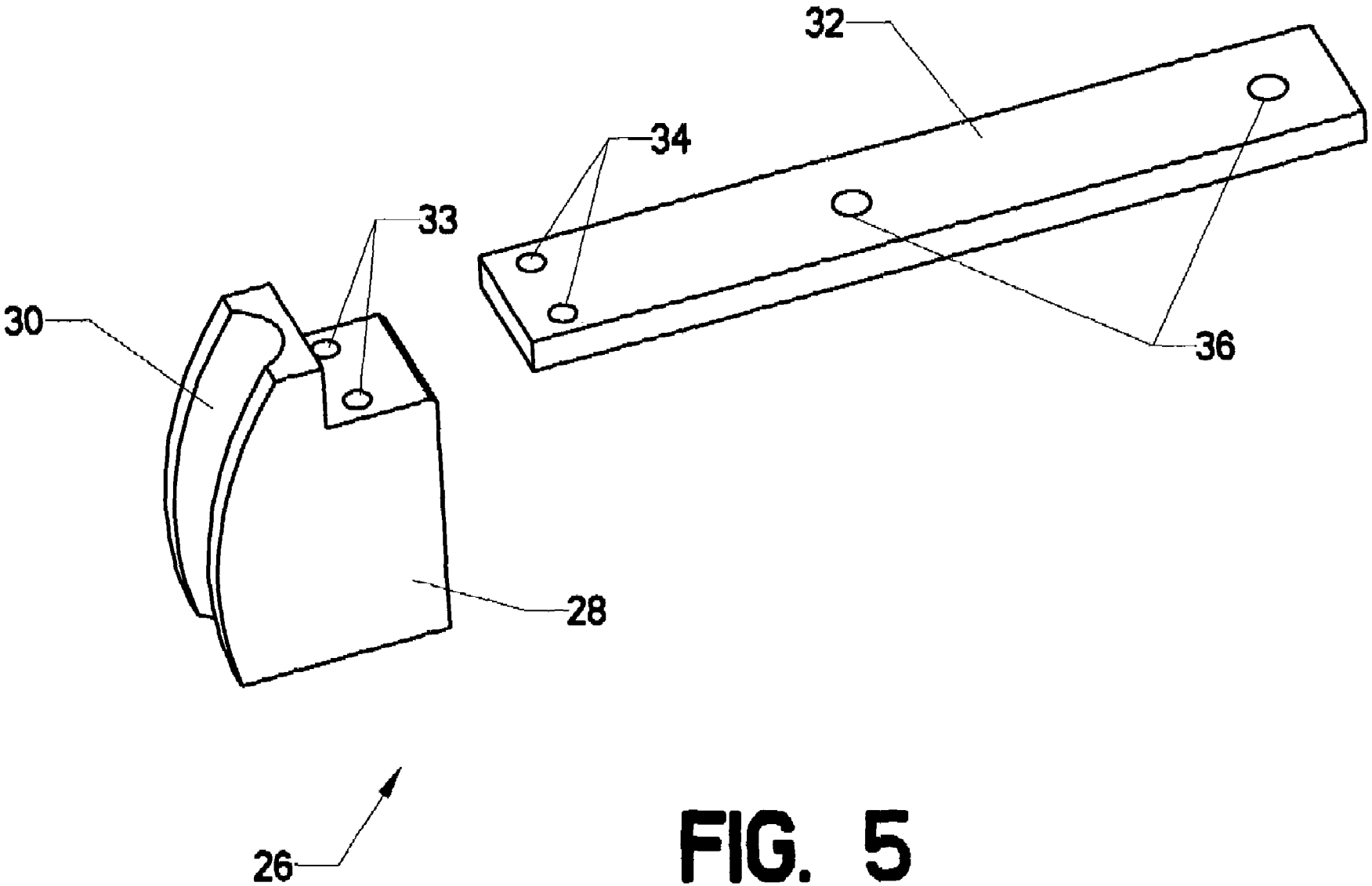
FIG. 5 is a perspective view, showing a first embodiment of the present invention, using a single mounting arm.

FIG. 5 is an exploded perspective view showing one embodiment of the present invention (universal spreader tip 26). Rigging interface 28 includes a cable receiver 30 as in the prior art. The cable receiver can assume many forms. A curved slot is shown. It can also be a vee notch, a square notch, or any other shape tending to retain the cable within the receiver. Some very simple designs include only a block with a hole passing through it to accommodate the cable.

Additional hardware may be employed to further retain the cable. U-bolts can be secured over the cable in order to hold it within the receiver. Elastic or inelastic closure mechanisms can also be used to close over the cable once the cable is within the receiver. Such closure mechanisms include toggles, latches, elastic cords, and hasps. These elements are known to those skilled in the art, and have therefore not been illustrated.

In the particular example shown in FIG. 5, mounting arm 32 is attached to rigging interface 28 by placing a pair of bolts within through holes 34 and threading them into threaded holes 33 on rigging interface 28. Tightening these bolts then draws the mounting arm into the notch provided.

Figure 6:
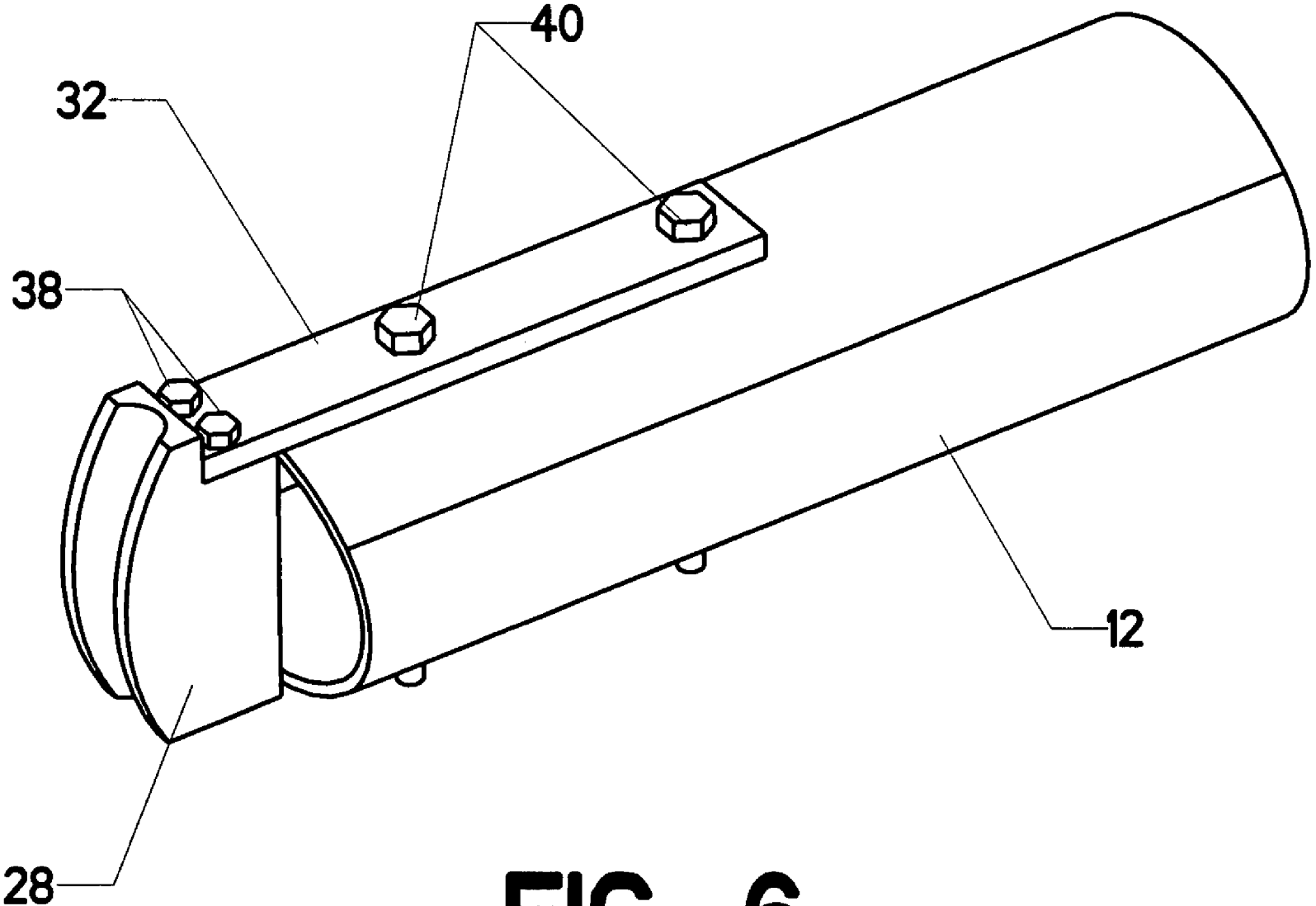
FIG. 6 is a perspective view, showing the installation of the first embodiment on a spreader bar.

Mounting arm 32 may include one or more mounting holes 36. These can be used to mount universal spreader tip 26 on a spreader bar. FIG. 6 shows the universal spreader tip in place on spreader bar 12. Two holes have been drilled through the spreader bar so that bolts 40 can be passed through mounting holes 36 on mounting arm 32 and then completely through the spreader bar.

Figure 7:
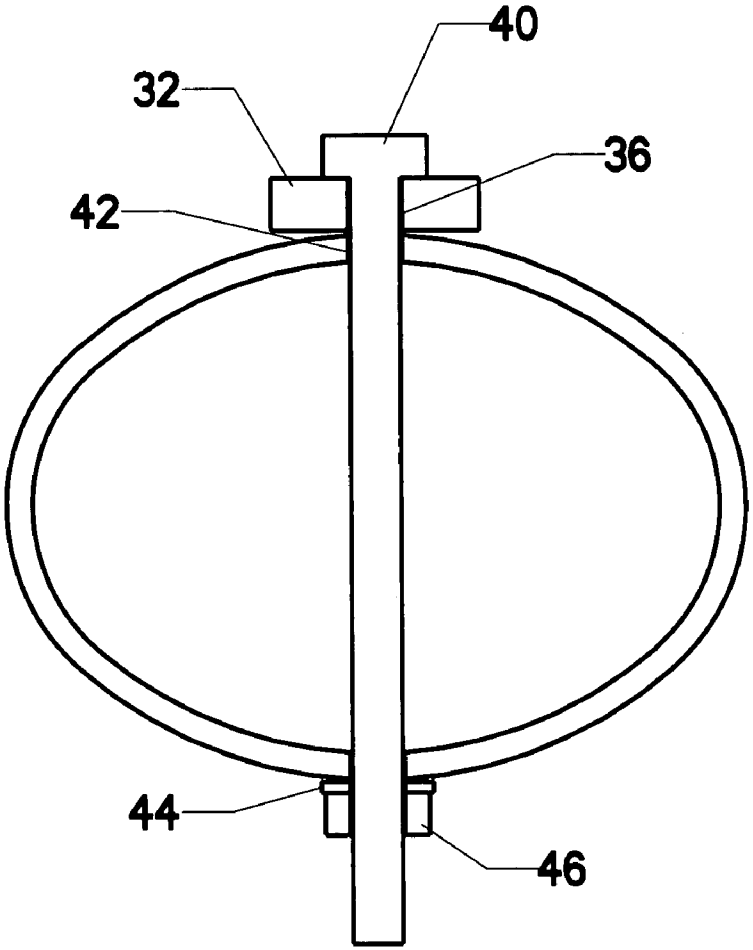
FIG. 7 is a section view, showing the installation of the first embodiment on a spreader bar.

FIG. 7 shows a sectioned elevation view through one of the mounts. Washer 44 and nut 46 are placed on the portion of bolt 40 which protrudes beyond the bottom of the spreader bar. Drilled hole 42 passes all the way through the spreader bar. When the nut is tightened, the mounting arm is drawn tightly against the upper surface of the spreader bar.

Returning to FIG. 6, the reader will thereby appreciate that when a cable is placed within rigging interface 28, the inward force will pass through the rigging interface, through the mounting arm, and to the end of the spreader bar. When a spreader bar having a hollow end is present, it is advantageous to make rigging interface 28 tall enough to contact both the upper extreme and lower extreme of the spreader bar's lateral facing surface. FIG. 7 shows how mounting arm 32 only tends to contact a small portion of the spreader bar's external circumference. This situation is satisfactory for many applications. However, if more rotational stability is desired, it may be desirable to have contact at two or more points.

Figure 8:
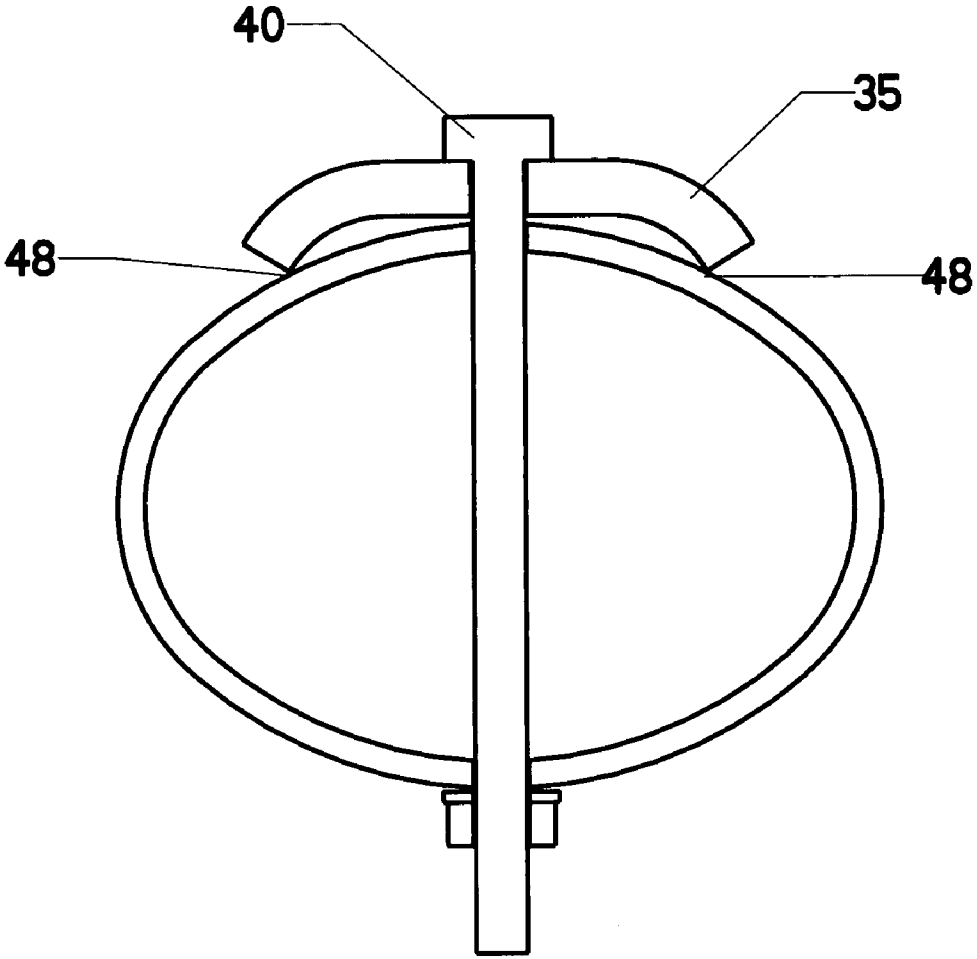
FIG. 8 is a section view, showing a second embodiment featuring an arched mounting arm.
Figure 21:
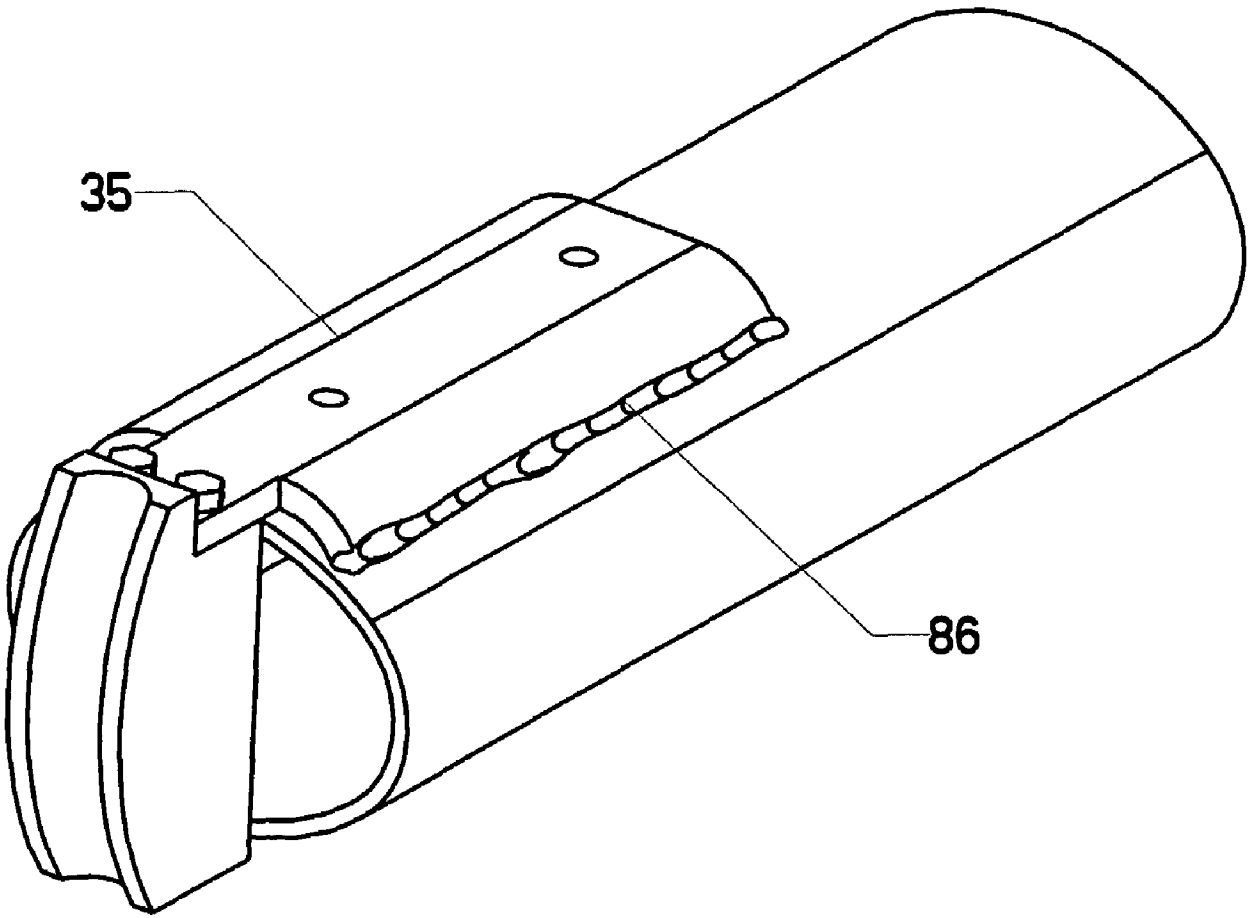
FIG. 21 is a perspective view, showing a weld between the mounting arm and the spreader bar.

FIG. 8 shows a similar assembly, in which arched mounting arm 35 has been substituted for mounting arm 32. The arched design allows contact at two separated points, labeled in the view as contact points 48 (The term "contact points" refers to the cross section in the view. The "points" are actually lines extending along the length of the arched mounting arm). Those skilled in the art will know that a suitably sized arch can accommodate a wide variation in sizes and shapes for the spreader bar. The arch also facilitates the use of a welded attachment. FIG. 21 shows arched mounting arm 35 joined to the spreader bar by a weld 86. A weld seam is formed along the junctions of the arched mounting arm and the spreader bar. Since the arched mounting arm only contacts the spreader bar along two lines, two weld seams are used.

Figure 9:
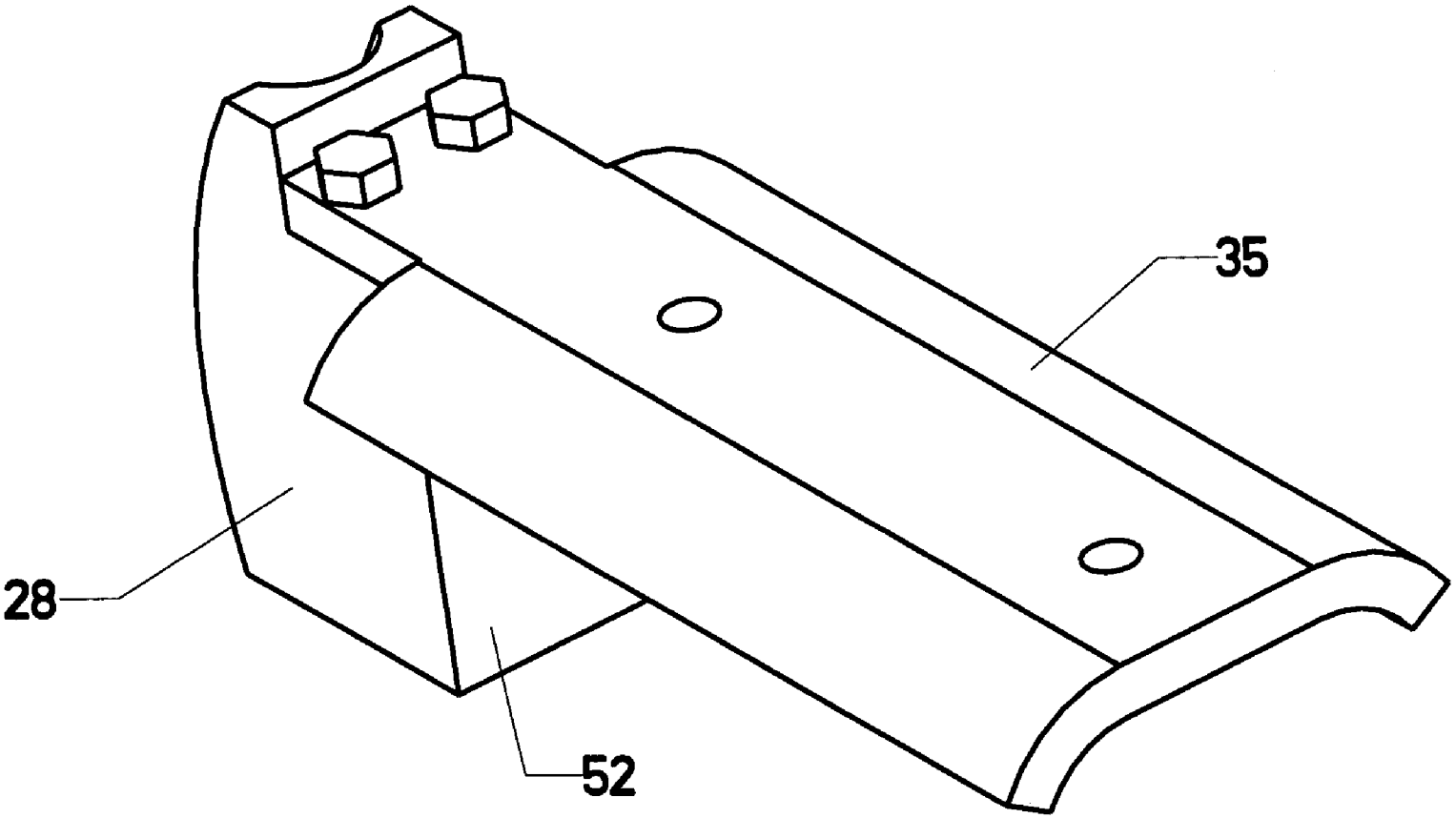
FIG. 9 is a perspective view, showing the embodiment of FIG. 8.

FIG. 9 shows a perspective view of arched mounting arm 35. It is shown bolted to a rigging interface 28 which is identical to the one shown for the embodiment of FIGS. 5-7. The use of a bolted attachment between the mounting arm and the rigging interface is only one approach. The rigging interface and mounting arm could be made as a single piece. Alternatively, the assembly can be made by welding together two separate pieces. Rivets or adhesives could also be used to join the rigging interface and the mounting arm. The two components could likewise be joined by press fitting them together, swaging one portion of one component over the other component, or using integral threaded features.

The profile shown for the example of the "arched" mounting arm is not a continuous, classical arch (which typically comprises a continuous arc). In the context of this disclosure, the term "arched" is intended to mean a mounting arm having two contact points with a relieved, non-contacting portion therebetween. The term "arched" will therefore be understood to include many different profiles, including a "U" shape and a "V" shape, among others.

Since there are many different sizes and shapes of spreader bars, it is important that the mounting arm(s) make discontinuous contact around the spreader bar's circumference. The term "discontinuous contact" means that the mounting arm(s) only contacts a portion of the circumference. The term "circumference" means the entire perimeter of the spreader bar's outer surface. FIG. 7 and FIG. 8 both show such discontinuous contact.

Figure 10:
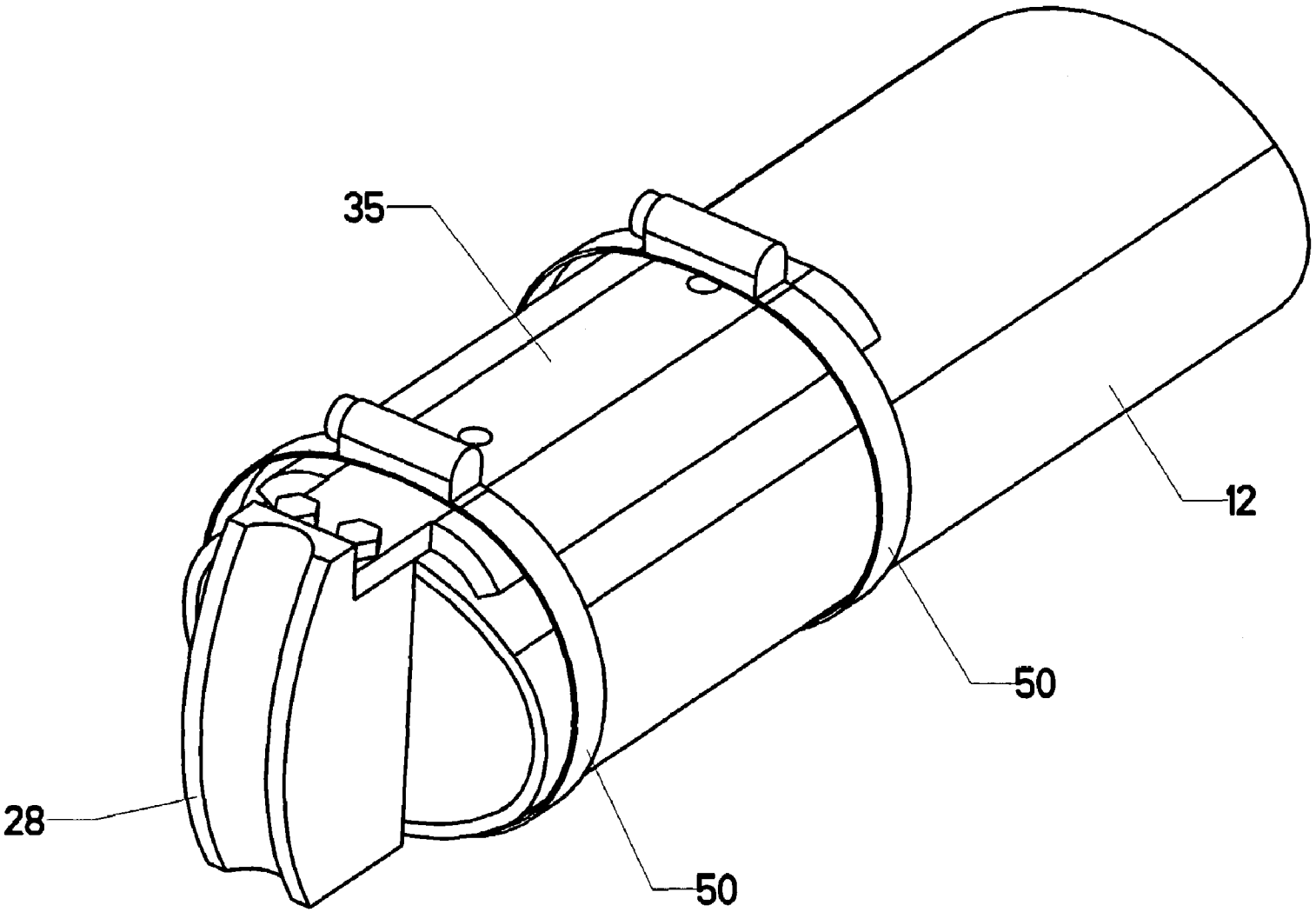
FIG. 10 is a perspective view, showing the use of straps to attach the spreader tip.

The mounting arm or arms can be attached to the spreader bar using many different methods. Bolts have been shown, and these are certainly widely available. However, it is possible to create the attachment without drilling holes in the spreader bar. FIG. 10 shows one such embodiment. The connection between arched mounting arm 35 and spreader bar 12 is made by clamping one or more screw clamps 50 around the assembly. The screw clamps are a sturdy version of common hose clamps. They are able to tightly clamp the arched mounting arm against a portion of the spreader bar's circumference. Other types of banding straps could be used as well. Any device which passes around the spreader bar and mounting arm(s) to provide a clamping force would work. In this disclosure, these items will be generally referred to as "banding devices." A reinforced tape wrapping could serve as a banding device.

This type of arrangement does not resist the inward pressure of the cable as well as the bolted version. Returning briefly to FIG. 9, the reader will observe that inner surface 52 of rigging interface 28 faces the end of the spreader bar. In FIG. 10, inner surface 52 is preferably positioned to bear against the end of the spreader bar (lateral facing surface 74). This contact prevents the arched mounting arm from slipping through the screw clamps under cable tension.

The substitution of the screw clamps or banding straps for the bolts can be made in any of the embodiments shown, and should not be exclusively associated with the arched version of the mounting arm. Many other methods could be used to attach any of the mounting arms to the spreader bar. A welded joint could be made. Rivets could be used. Reinforced adhesives could also be used. These approaches, as well as many others, are well known to those skilled in the art.

Figure 11:
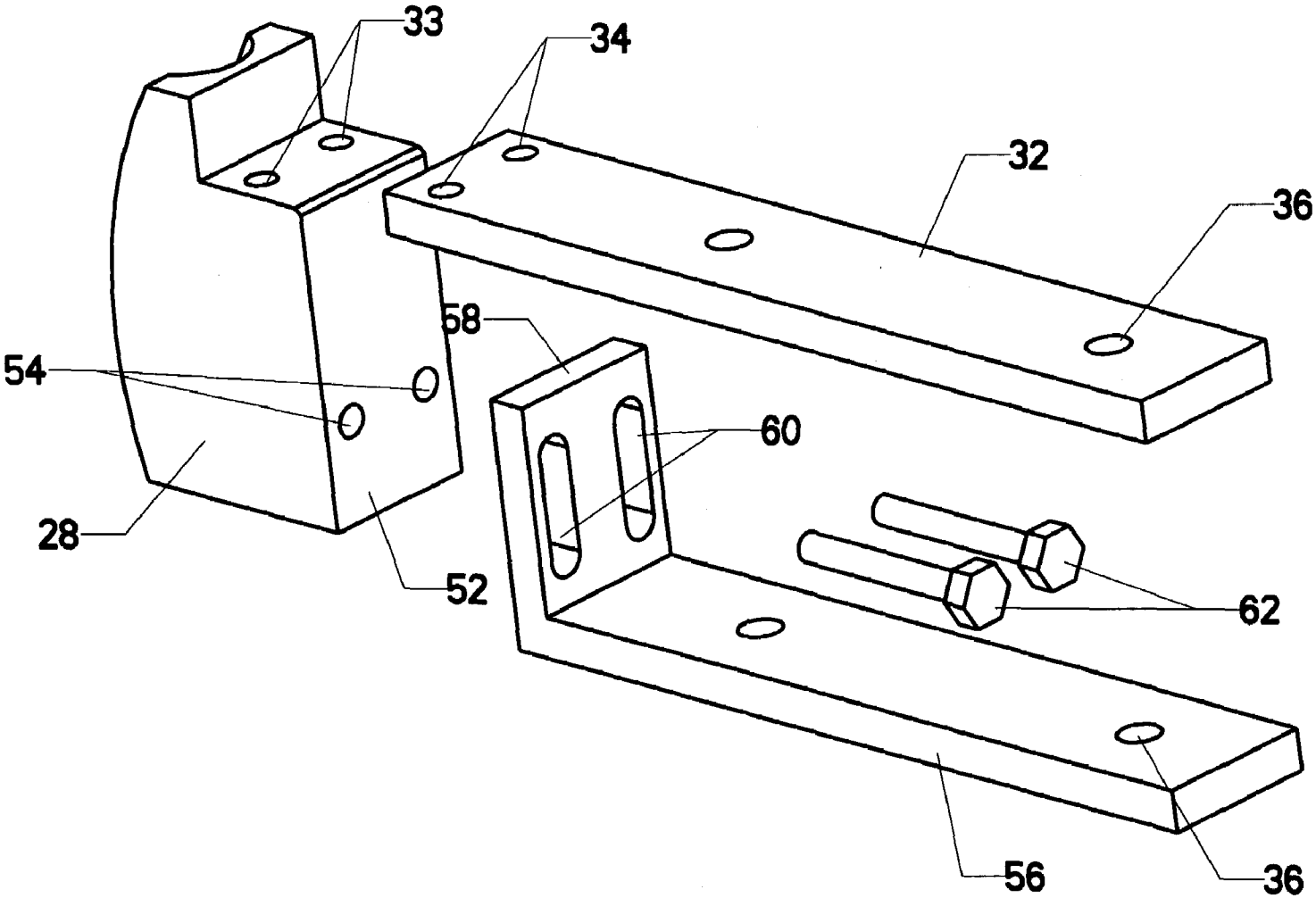
FIG. 11 is a perspective view, showing an embodiment with two mounting arms.

In some applications the use of two mounting arms is preferred. FIG. 11 shows such an embodiment. Two threaded holes 54 are added to inner surface 52 of rigging interface 28. Adjustable mounting arm 56 has two vertical slots 60 in mounting plate 58. Bolts 62 are used to adjustably secure adjustable mounting strap 56 to inner surface 52.

Figure 12:
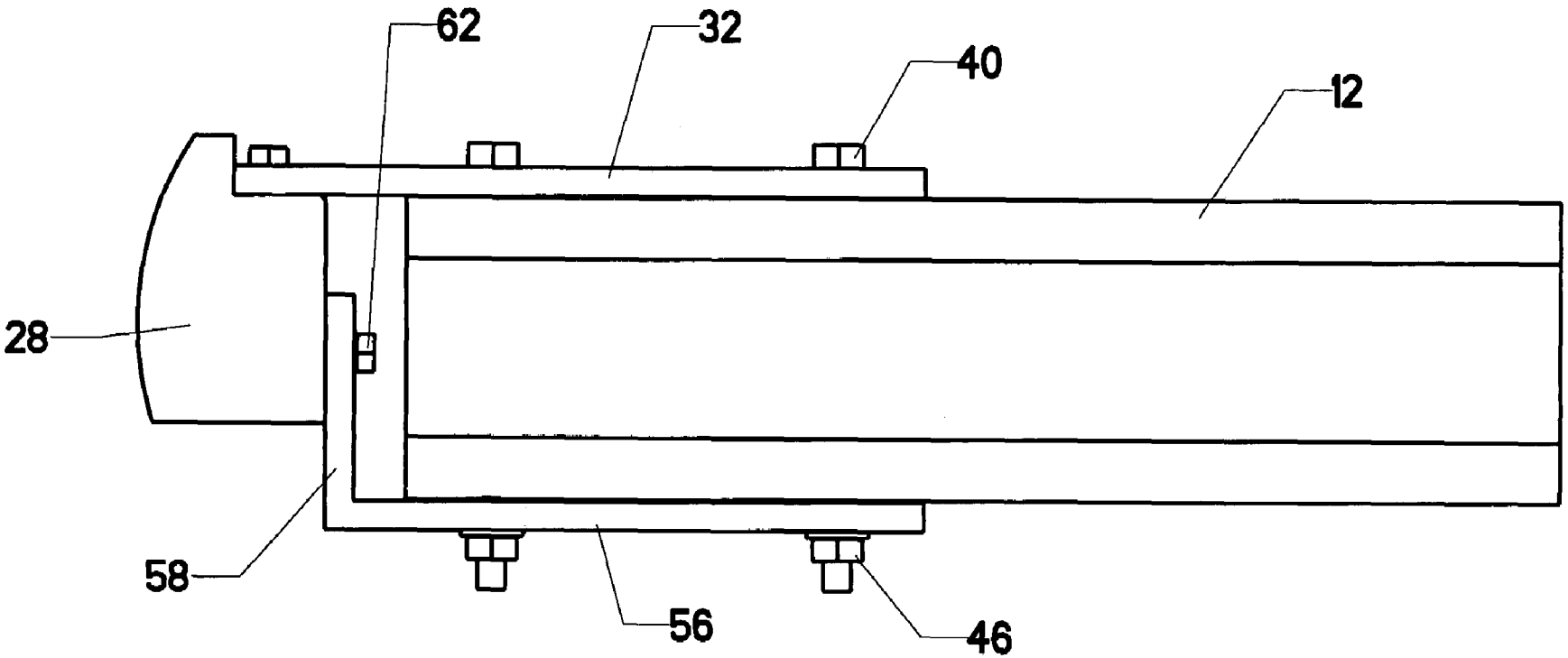
FIG. 12 is an elevation view, showing the embodiment of FIG. 11 mounted on a spreader bar.

The adjustable mounting arm can be raised and lowered to accommodate different size spreader bars. FIG. 12 shows this embodiment attached to a relatively large spreader bar 12. For this illustration, bolts 40 are used as the method of attachment. The reader will observe that adjustable mounting arm 56 has been moved downward with respect to the rigging interface. The attachment position can be varied to suit the application. It may be desirable to move the rigging interface to the right in the view, so that the back of mounting plate 58 bears against the lateral facing surface of the spreader bar.

Figure 13:
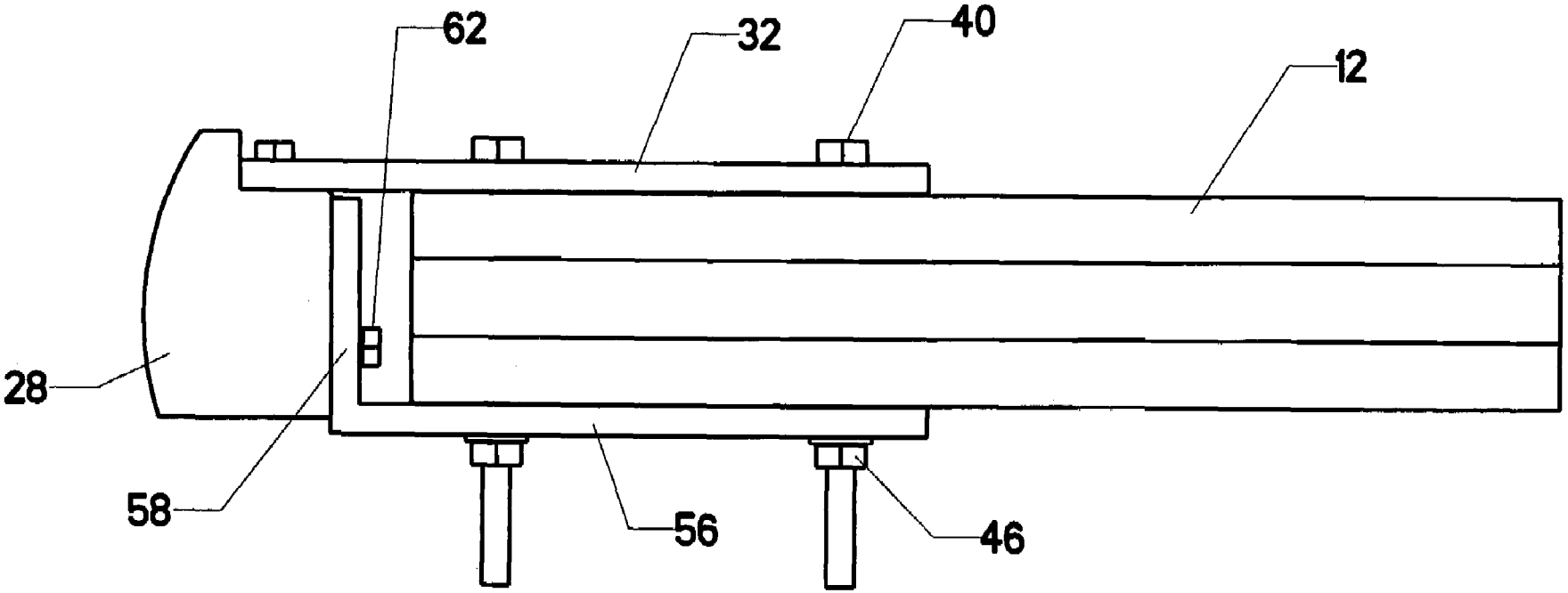
FIG. 13 is an elevation view, showing the embodiment of FIG. 11 mounted on a spreader bar.

FIG. 13 shows the same assembly attached to a relatively small spreader bar. The two bolts 62 were loosened so that adjustable mounting arm 56 could be moved upward with respect to the rigging interface. Holes were again drilled through the spreader bar, and two bolts were again used to secure the mounting arms in place. The reader will thereby perceive how one or more of the mounting arms can be made adjustable to accommodate variations in the spreader bars.

Figure 14:
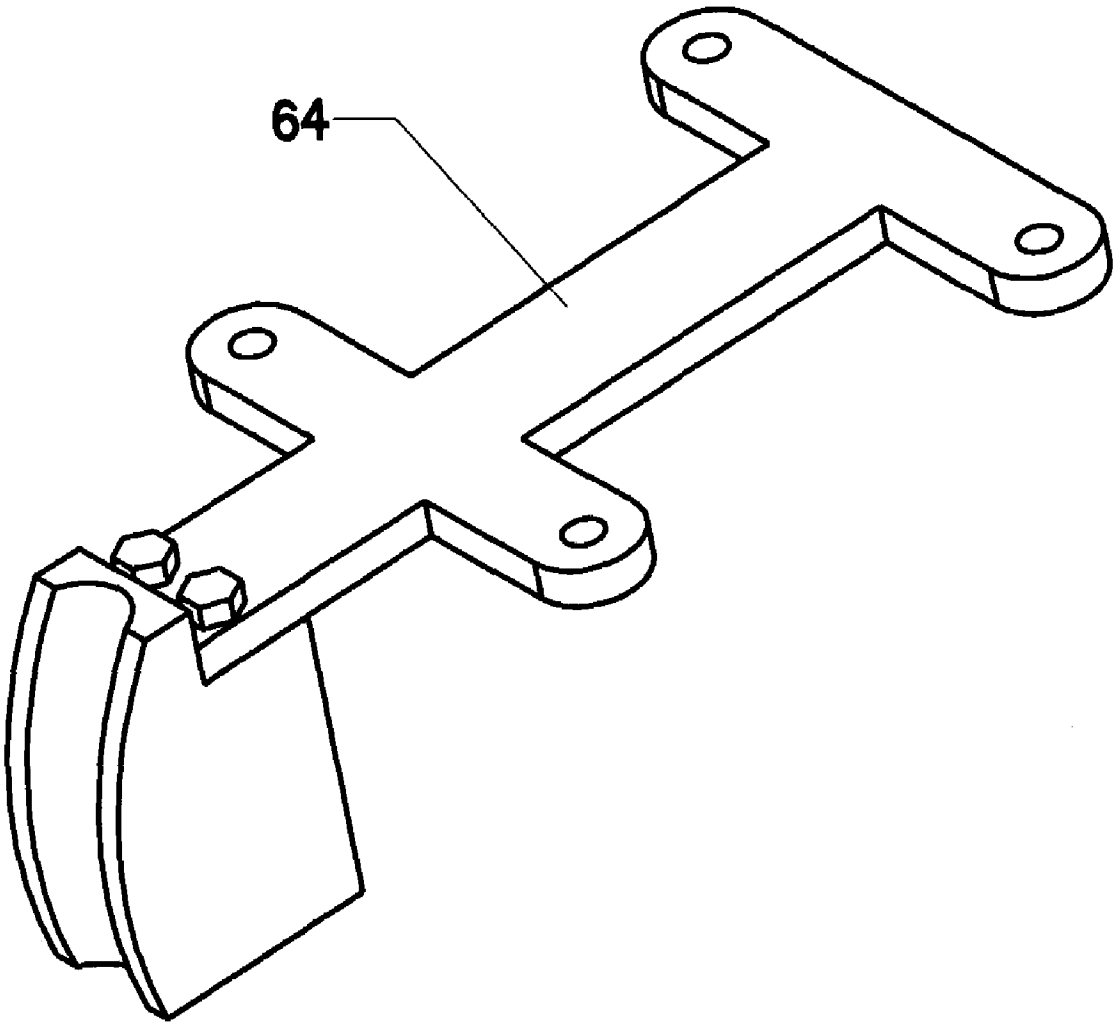
FIG. 14 is a perspective view, showing an embodiment with a wide mounting arm.
Figure 15:
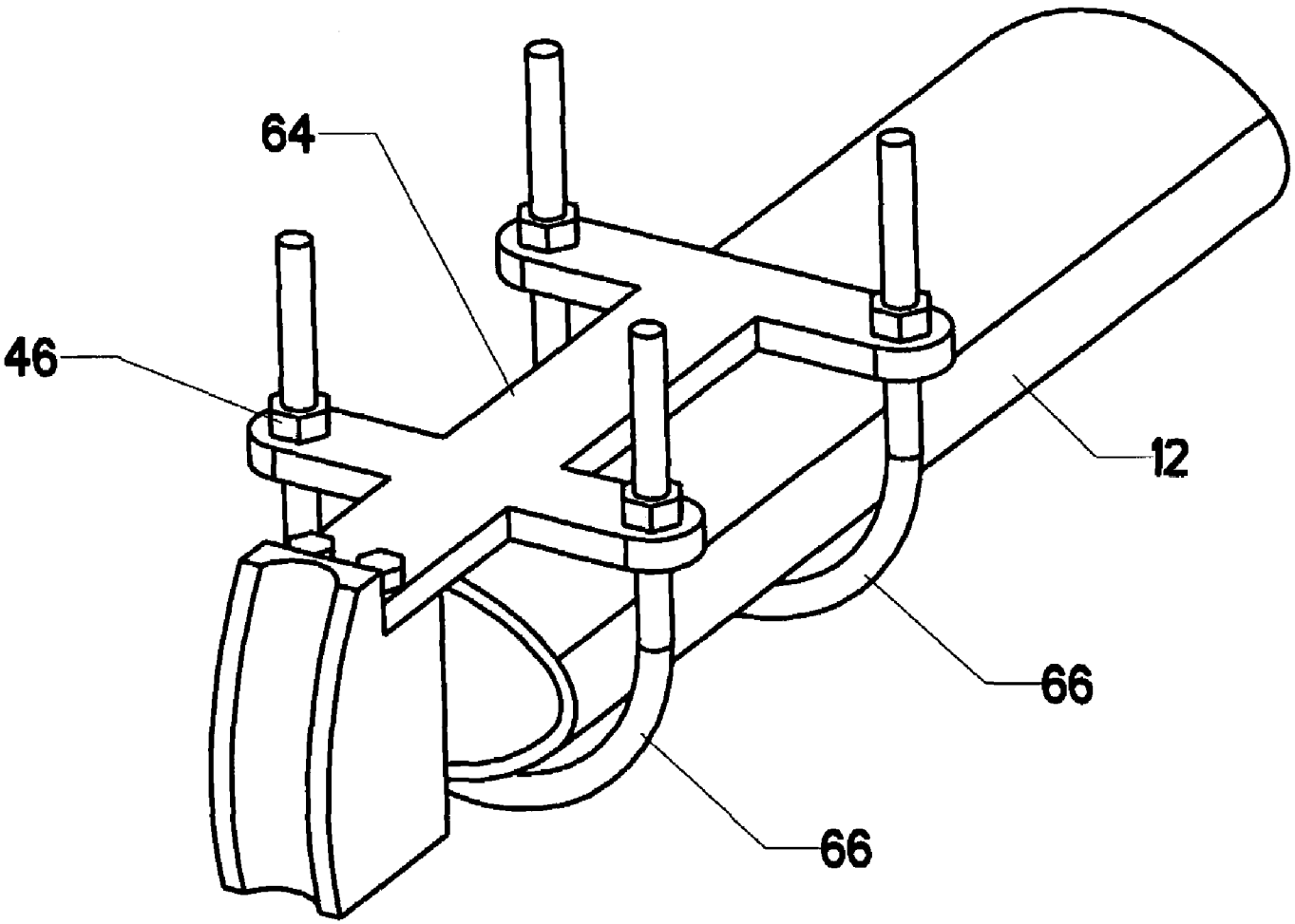
FIG. 15 is an elevation view, showing the embodiment of FIG. 14 mounted on a spreader bar.

FIGS. 14 and 15 show yet another variation in the attachment method. FIG. 14 shows wide mounting arm 64, which includes four through holes spaced significantly apart. In FIG. 15, two U-bolts 66 have been passed around spreader bar 12 and through the holes in wide mounting arm 64. Four nuts 46 are then threaded onto the exposed ends of the U-bolts in order to securely clamp the mounting arm to the spreader bar.

Figure 16:
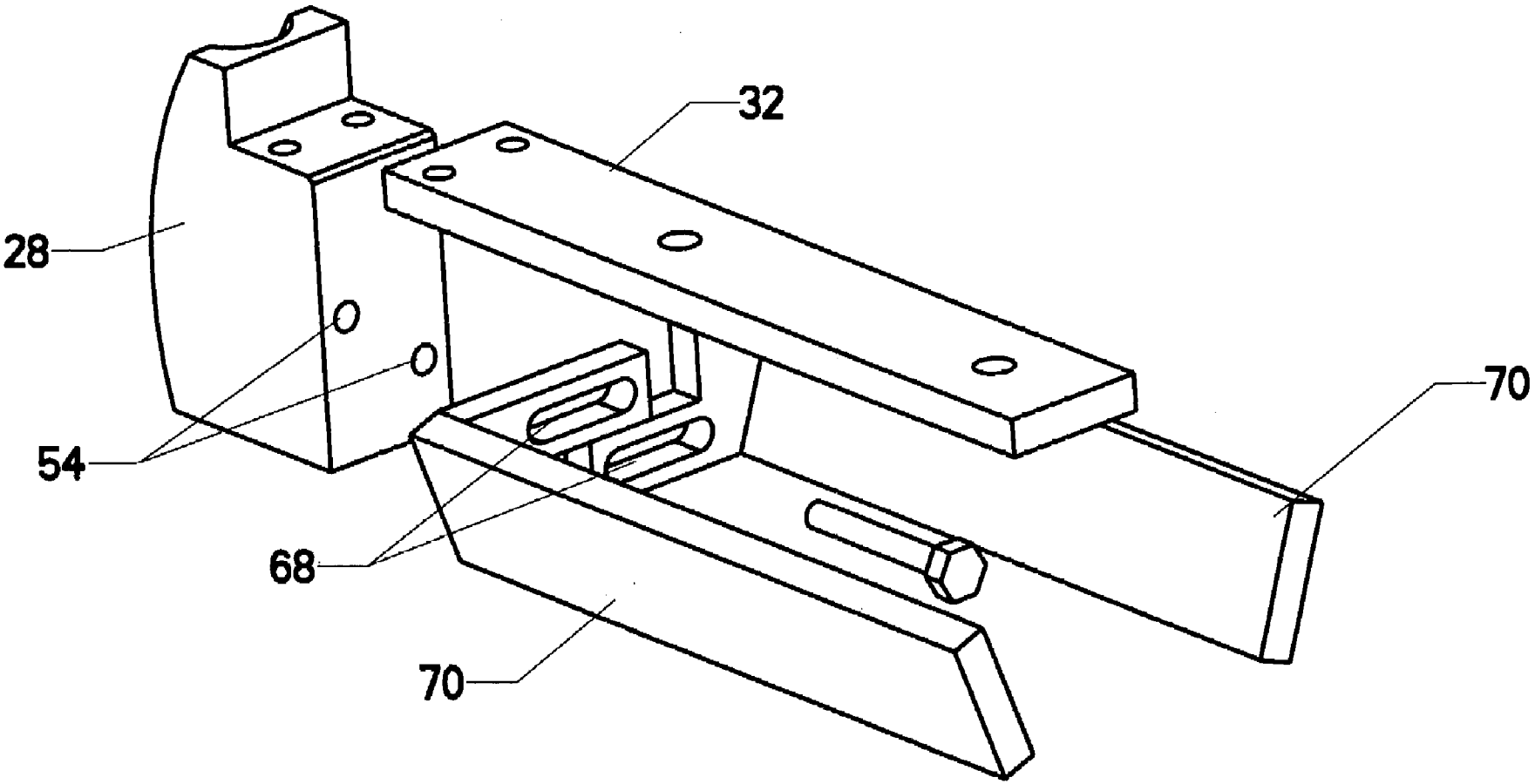
FIG. 16 is a perspective view, showing an embodiment using three mounting arms.

Three or more mounting arms can be used in some embodiments. FIG. 16 shows an embodiment using three mounting arms. A fixed mounting arm 32 is used as before. Two lateral mounting arms 70 are added. These feature lateral slots 68, which allow the lateral mounting arms to be laterally adjusted with respect to the rigging interfaces. A pair of bolts pass through these lateral slots and thread into threaded holes 54 on the rigging interface (only one bolt is shown in the view). The reader will note that the lateral slots are located in a pair of nesting tabs, so that each lateral arm can be independently adjusted.

Figure 17:
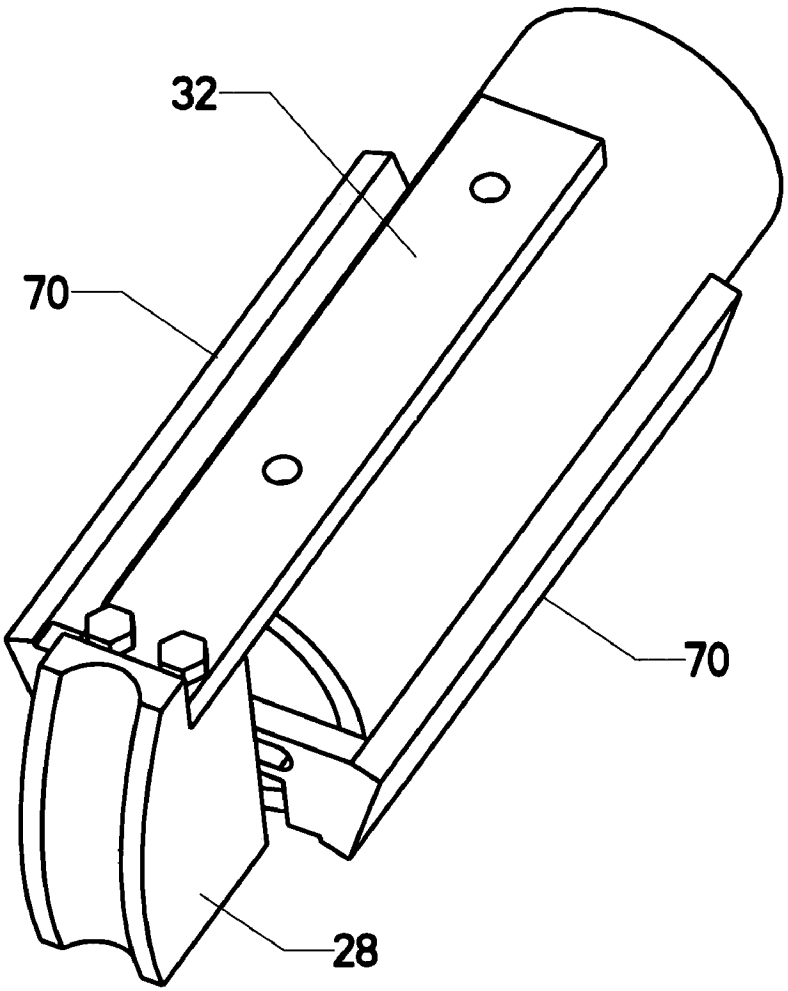
FIG. 17 is a perspective view, showing the embodiment of FIG. 16 attached to a spreader bar.

FIG. 17 shows this embodiment installed on the end of a spreader bar. Those skilled in the art will know that the independent adjustment of the two lateral mounting arms allows the device to discontinuously contact the circumference of many different spreader bars. Once in position, the attachment between the mounting arms and the spreader bar can be made as described previously (bolts, screw clamps, rivets, adhesives, reinforced tape, banding straps, etc.). The reader should also note that all three mounting arms can be made adjustable.

Figure 18:
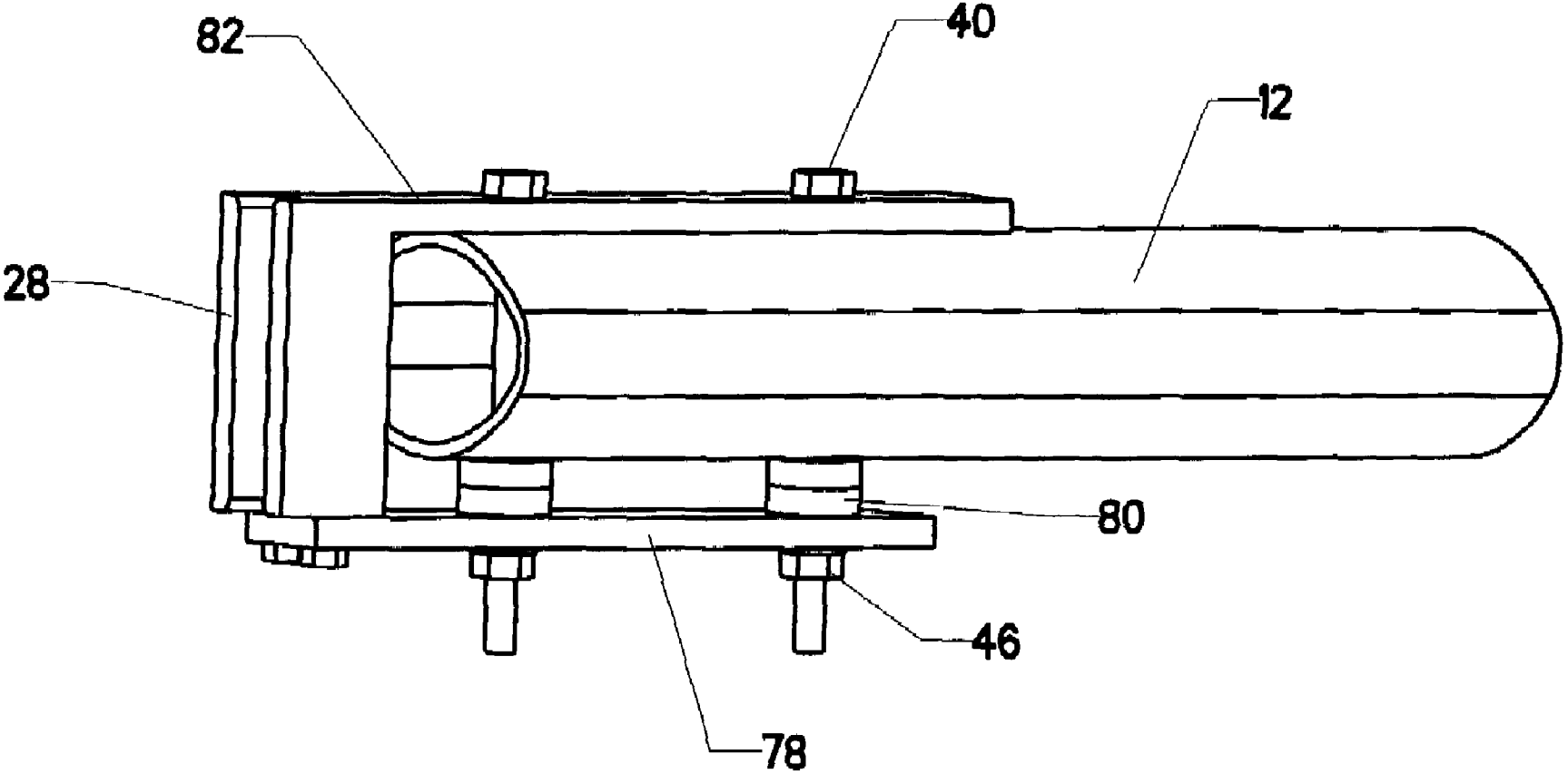
FIG. 18 is a perspective view, showing the use of spacers to adapt the spreader tip to different spreader bar sizes.

Other hardware can be used to account for variations in spreader bar size as well. FIG. 18 shows an embodiment where rigging interface 28 and upper mounting arm 82 have been made as one integral unit. Lower mounting arm 78 bolts onto the bottom of rigging interface 28. Thus, it is not possible to adjust the vertical separation between the upper and lower mounting arms. Instead, one or more spacers 80 are placed on each bolt 40 in order to provide the proper spacing.

Of course, spacers could also be placed between the rigging interface and the lower arm. That arrangement would allow installation on a much larger spreader bar.

Figure 19:
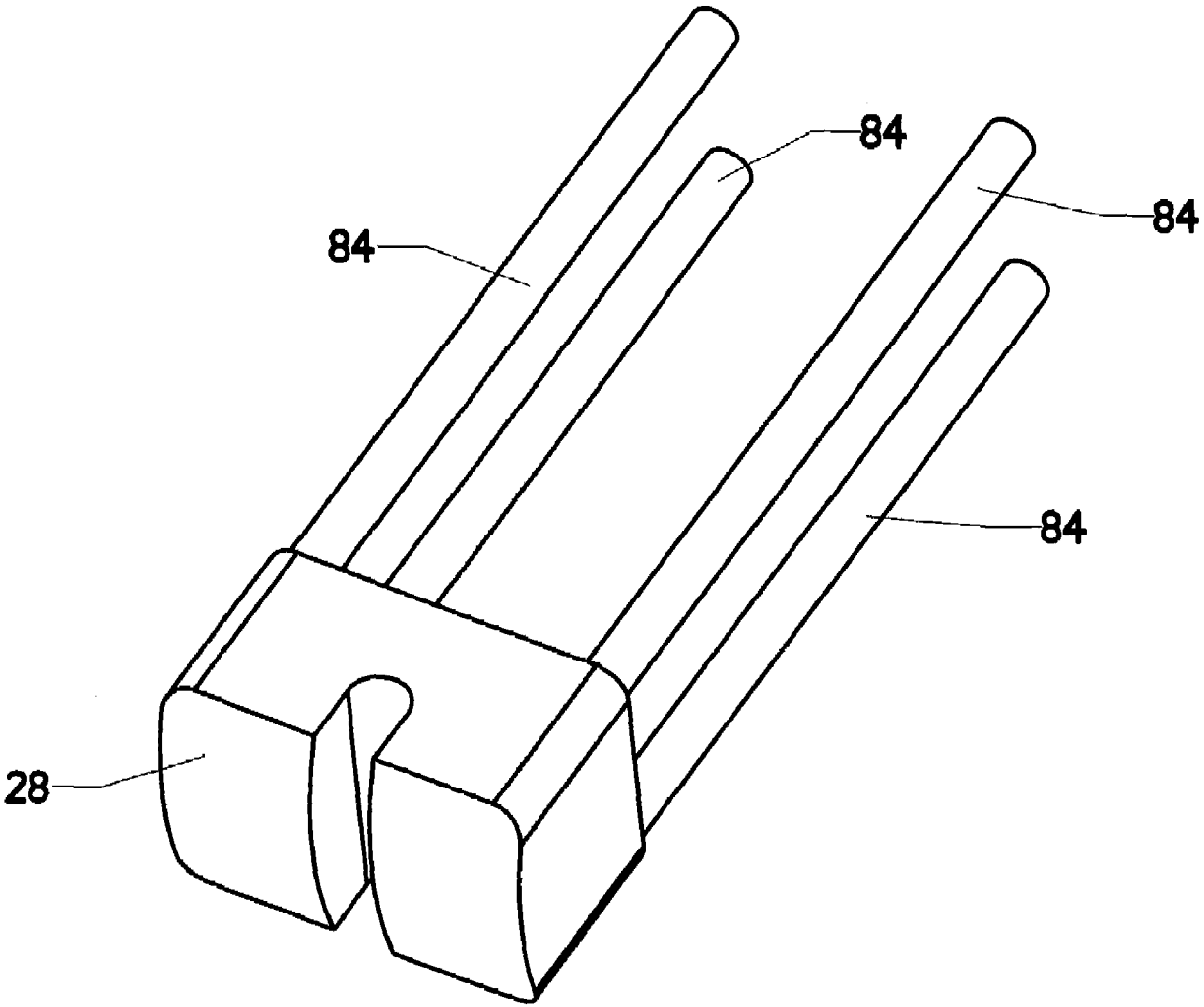
FIG. 19 is a perspective view, showing an embodiment with four mounting arms.
Figure 20:
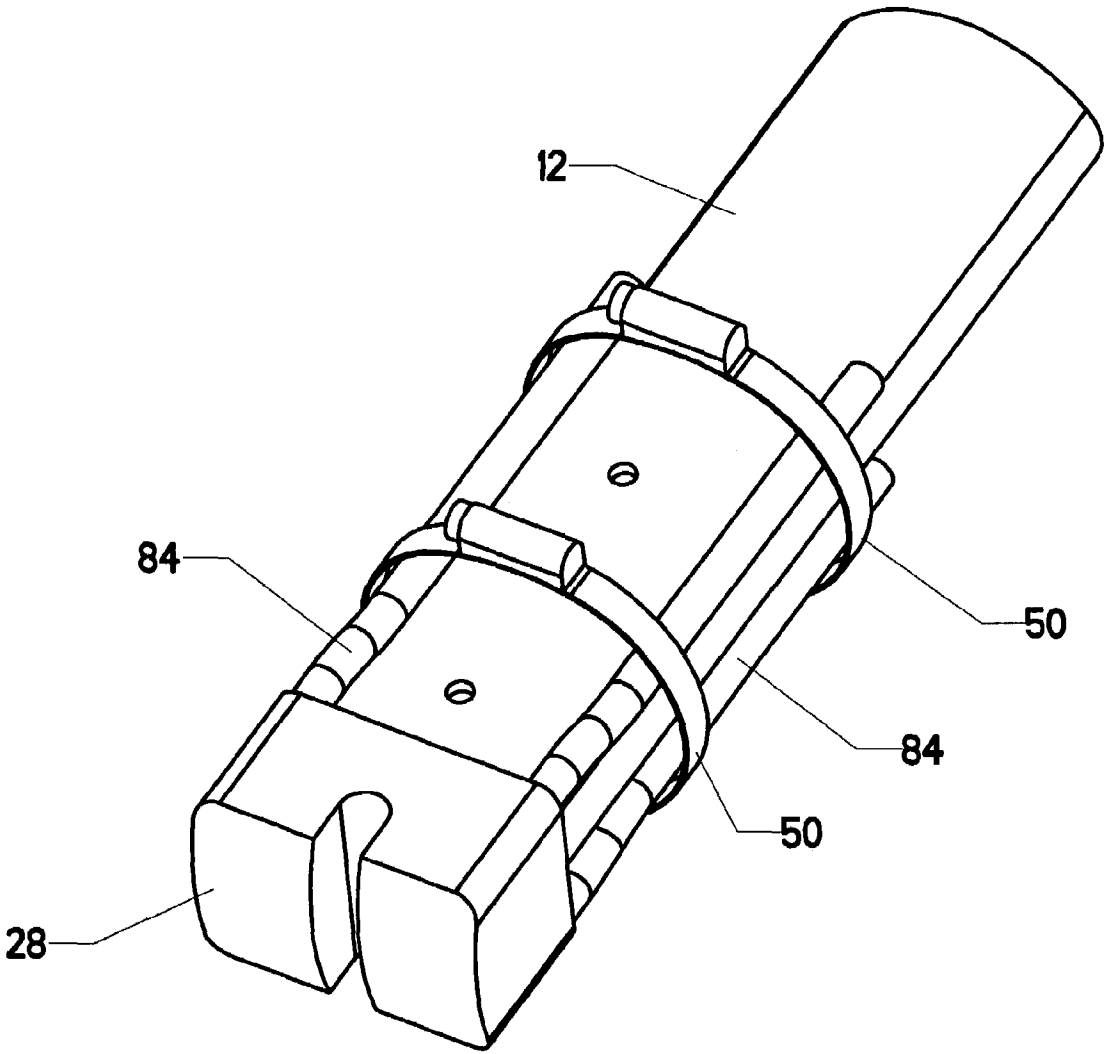
FIG. 20 is a perspective view, showing the embodiment of FIG. 19 attached to a spreader bar.

For some applications it may be desirable to use four mounting arms. FIG. 20 shows such an embodiment. Four mounting arms 84 are attached to rigging interface 28. It may be preferable to make these from a fairly flexible material. As one example, the entire assembly shown in FIG. 19 could be molded as one integral piece of DELRIN plastic. Alternatively, it could be cast as a single piece of soft aluminum. Either approach would allow the four mounting arms to deflect inward in order to contact smaller spreader bars. The deflection serves as an adjustment for different spreader bar shapes and sizes.

FIG. 20 shows the device attached to the end of a spreader bar. Two screw clamps 50 have been positioned to encircle the four mounting arms and clamp them inward against the spreader bar. The mounting arms could also be manually bent inward and attached to the spreader bar by other means. The deflection therefore serves as an adjustment feature.

Finally, there are numerous permutations of the options presented which have not been described in detail. While it is impractical to illustrate every possible permutation, the reader will understand that the components described can be combined in many different ways. The scope of the present invention should thus be defined by the following claims rather than any specific examples given.

The invention claimed is:

1. A spreader tip for locating a cable relative to a spreader bar, said spreader bar including an end, a lateral facing surface, and a circumference proximate said end, comprising:

a. a rigging interface, including a cable receiver, said rigging interface being configured to be located outboard of said lateral facing surface;

b. at least one mounting arm, attached to said rigging interface and extending inward over said spreader bar;

c. wherein said at least one mounting arm extends over a portion of said circumference proximate said end of said spreader bar;

d. wherein said at least one mounting arm is attached to said spreader bar so that said at least one mounting arm contacts said portion of said circumference and said rigging interface lies proximate said end;

e. a second mounting arm, attached to said rigging interface and extending inward over said spreader bar;

f. wherein said second mounting arm extends over a second portion of said circumference proximate said end of said spreader bar;

g. wherein said second mounting arm is attached to said spreader bar so that a portion of said spreader bar lies between said at least one mounting arm and said second mounting arm;

h. a third mounting arm, attached to said rigging interface and extending inward over said spreader bar;

i. wherein said third mounting arm extends over a third portion of said circumference proximate said end of said spreader bar; and j. wherein said third mounting arm is attached to said spreader bar so that said spreader bar lies between said at least one mounting arm, said second mounting arm, and said third mounting arm.

2. A spreader tip as recited in claim 1, wherein said attachment between said rigging interface and said third mounting arm is adjustable, so that the distances between said at least one mounting arm and said second and third mounting arms are adjustable.

3. A spreader tip as recited in claim 1, further comprising:

a. a fourth mounting arm, attached to said rigging interface and extending inward over said spreader bar;

b. wherein said fourth mounting arm extends over a fourth portion of said circumference proximate said end of said spreader bar; and c. wherein said fourth mounting arm is attached to said spreader bar so that said spreader bar lies between said at least one mounting arm, said second mounting arm, said third mounting arm, and said fourth mounting arm.

4. A spreader tip for locating a cable relative to a spreader bar, said spreader bar including an end, a lateral facing surface, and a circumference proximate said end, comprising:

a. a rigging interface, including a cable receiver, said rigging interface being configured to be located outboard of said lateral facing surface;

b. at least one mounting arm, attached to said rigging interface and extending inward over said spreader bar;

c. wherein said at least one mounting arm extends over a portion of said circumference proximate said end of said spreader bar;

d. wherein said at least one mounting arm is attached to said spreader bar so that said at least one mounting arm contacts said portion of said circumference and said rigging interface lies proximate said end;

e. a second mounting arm, attached to said rigging interface and extending inward over said spreader bar;

f. wherein said second mounting arm extends over a second portion of said circumference proximate said end of said spreader bar;

g. wherein said second mounting arm is attached to said spreader bar so that a portion of said spreader bar lies between said at least one mounting arm and said second mounting arm; and h. a spacer located between said second mounting arm and said spreader bar.

5. A spreader tip as recited in claim 1, wherein said first, second, and third mounting arms are attached to said spreader bar by an attachment means selected from the group consisting of a threaded fastener, a rivet, a banding device, a weld, and an adhesive bond.

6. A spreader tip as recited in claim 3, wherein said first, second, third, and fourth mounting arms are attached to said spreader bar by an attachment means selected from the group consisting of a threaded fastener, a rivet, a banding device, a weld, and an adhesive bond.

7. A spreader tip as recited in claim 1, further comprising:

a. a spacer located between said second mounting arm and said spreader bar; and b. a spacer located between said third mounting arm and said spreader bar.

8. A spreader tip as recited in claim 3, further comprising:

a. a spacer located between said second mounting arm and said spreader bar;

b. a spacer located between said third mounting arm and said spreader bar; and c. a spacer located between said fourth mounting arm and said spreader bar.

9. A spreader tip as recited in claim 1, wherein said adjustable attachment between said rigging interface and said second mounting arm comprises providing a deformable material for said second mounting arm so that said second mounting arm can be deflected toward said first mounting arm.

10. A spreader tip as recited in claim 2, wherein said adjustable attachment between said rigging interface and said third mounting arm comprises providing a deformable material for said third mounting arm so that said third mounting arm can be deflected toward said first mounting arm.

11. A spreader tip as recited in claim 3, wherein said attachment between said rigging interface and said fourth mounting arm is adjustable, so that the distances between said at least one mounting arm and said fourth mounting arm is adjustable.

12. A spreader tip as recited in claim 11, wherein said adjustable attachment between said rigging interface and said fourth mounting arm comprises providing a deformable material for said fourth mounting arm so that said fourth mounting arm can be deflected toward said first mounting arm.

* * * * *